US006067886A

United States Patent [19]

Irwin

[11] Patent Number: 6,067,886

[45] **Date of Patent: *May 30, 2000**

[54] MACHINE TRIM PRESS HAVING COUNTERBALANCE FEATURES

[75] Inventor: Jere F. Irwin, Yakima, Wash.

[73] Assignee: The Vision Limited Partnership, Yakima, Wash.

[ * ] Notice: This patent issued on a continued prosecution application filed under 37 CFR 1.53(d), and is subject to the twenty year patent term provisions of 35 U.S.C. 154(a)(2).

[21] Appl. No.: 08/691,856

[22] Filed: Aug. 2, 1996

[51] Int. Cl.[7] ..... B26D 5/08; B30B 1/06

[52] U.S. Cl. ..... 83/615; 83/628; 83/629; 83/632; 83/691; 83/698.71; 100/282

[58] Field of Search ..... 83/632, 615, 628, 83/698.71, 686, 687, 690, 691, 629; 100/282

[56] References Cited

U.S. PATENT DOCUMENTS

| | | | |
|---|---|---|---|
| 2,440,848 | 5/1948 | Conner | 83/615 X |
| 3,797,385 | 3/1974 | Goff | 100/282 X |
| 3,808,912 | 5/1974 | Voorhees et al. | 100/282 X |
| 3,858,432 | 1/1975 | Voorhees et al. | 100/282 X |
| 3,867,861 | 2/1975 | Hamisch, Sr. | 83/632 X |
| 3,987,521 | 10/1976 | Parkinson | 83/615 X |
| 4,014,232 | 3/1977 | Mauger | 83/628 X |
| 4,625,609 | 12/1986 | Ashworth | 83/615 X |
| 4,687,144 | 8/1987 | Irwin et al. | 241/49 |
| 4,890,524 | 1/1990 | Brown et al. | 83/615 |
| 5,136,875 | 8/1992 | Schockman | 83/615 X |
| 5,218,901 | 6/1993 | Imanishi | 100/282 X |
| 5,239,921 | 8/1993 | Porucznik et al. | 100/282 X |
| 5,513,561 | 5/1996 | Biliskov, Jr. et al. | 100/282 X |

FOREIGN PATENT DOCUMENTS

| | | | |
|---|---|---|---|
| 1435052 | 5/1976 | United Kingdom | 100/282 |
| 2109737 | 6/1983 | United Kingdom | 83/639 |

*Primary Examiner*—Rinaldi I. Rada
*Assistant Examiner*—Charles Goodman
*Attorney, Agent, or Firm*—Wells, St. John, Roberts, Gregory & Matkin, P.S.

[57] ABSTRACT

In accordance with one aspect of this invention an improved trim press is taught for use in separating molded articles from a web of material. The trim press includes a frame, a drive motor carried by the frame, a first platen carried by the frame, and a second platen carried by the frame and configured to be moved in reciprocation relative to the first platen. A first flywheel assembly is provided on the trim press having a weight with an eccentric mass, the weight being driven in rotation by the motor and coupled to drive the second platen via at least one kinematic linkage. The trim press also includes a second flywheel assembly having a weight with an eccentric mass, the weight being driven in rotation by the motor and coupled to drive the second platen via at least one kinematic linkage. In operation, the first flywheel assembly and the second flywheel assembly are constructed and arrange such that the eccentric mass of the associated weight on the first flywheel assembly is positioned in mirror image with the eccentric mass of the associate weight of the second flywheel assembly, the first and the second flywheel assemblies being driven in counter rotation so as to substantially cancel out dynamic forces produced out of the axis of movement of the movable platen. The flywheel assembly can also include an output shaft driven in rotation by the motor and a weight having interlocking features for mating the weight on the shaft for rotation.

13 Claims, 8 Drawing Sheets

MACHINE TRIM PRESS HAVING COUNTERBALANCE FEATURES

TECHNICAL FIELD

This invention relates to apparatus for separating thermal-formed thin walled plastic articles from a sheet of plastic material in which they have been formed.

BACKGROUND OF THE INVENTION

During the manufacture and forming of many products from sheets or webs of plastic material, thermal-forming machines are used to simultaneously mold large quantities of plastic thin-walled articles. A typical molded article is formed from one of a large variety of generally cup-shaped constructions, the article being formed between mating two-piece dies or molds suitable for imparting to the finished piece its final desired shape. A typical thermal-forming machine has a pair of mating male and female dies, or molds that are brought together on opposed sides of a pre-heated web of plastic material, during an operating cycle. Usually, a plurality of mating male and female dies are provided on bottom and top platens, or die carriers, respectively, enabling production of a plurality of articles during a single cycle of operation.

According to one set-up, a separate trim press machine is provided adjacent to the thermal forming machine for separating the plurality of molded articles from the web of plastic material. A typical machine trim press is set up adjacent to the output side of the thermal forming machine, where it operates on the web of plastic material to remove the molded articles immediately adjacent to the location where they have been formed. A typical trim press has a fixed lower platen and a reciprocating upper platen. Each platen is configured transverse to the path of travel of the web of plastic material, so that they come together on opposite sides of the web, while the web and the in-molded articles are held in an accurate fixed position between the platens. Complementary cutting surfaces are formed in the top and bottom platens in locations that severe the in-molded articles from the web of material as the platens close onto the web. Typically, the movable upper platen has a spring seated clamp that engages with the top of the web, forcing it into engagement on its bottom face with the lower platen. In this manner, the clamp locks the web into position over the lower platen, just prior to engagement of the cutting surfaces and severing of the web about each article. Alternatively, a spring seated stripper carried on the lower platen strips the web off the lower die, and furthermore, acts as a spring seated clamp which holds the web during severing.

Preferably, the lower platen is held in a fixed position, immediately beneath the web of material. In this manner, the lower platen also supports the web as it is fed into the trim press for a subsequent operating cycle. Typically, the web is fed into the trim press during the period of time that the upper platen is raised from the lower platen. As the upper platen is being lowered, the mechanism feeding the web is stopped at a desired location and the clamp (or stripper) further engages the web, fixing the web in an accurate location between the platens suitable to severe the articles therefrom.

Modern thermal forming machines have provided vast productivity improvements by increasing the rate with which articles can be produced from a single machine. Many of these machines are driven by one or more electric drive motors. Alternatively, hydraulic or pneumatic actuators can be used to impart motion to a thermal-forming machine.

Additionally, a control system or even a complex arrangement of kinematic linkages can be configured to choreograph the associated movements of feeding, heating, and forming of plastic articles by the machine. In fact, the use of computers and high speed processing has enabled vast improvements in cycle speed for thermal-forming machines.

However, as the productivity of thermal-forming (thermoforming) machines has increased dramatically, trim presses have become the slow component of a forming and cutting operation, limiting the output of the entire line. State of the art trim presses need to more than double the existing maximum expected rate of 160 cycles per minute (cpm) to rates in excess of 300 cpm. Such presently unsuitable state of the art devices include mechanical product picking devices, and even servo motor driven feed mechanisms.

Therefore, improvements to trim presses are needed in order to enable the trimming of articles from a web, particularly during high speed thermal-forming, or molding operations. One problem results from high speed movement of the upper platen which shakes the trim press. As machine cycle speed increases, the dynamic forces created by the moving upper platen of the trim press greatly complicate the design of an accurate high speed trim press machine. Even where flywheels are added to the kinematic drive linkage on the press, oscillations can still occur in the rotational velocity of the flywheel. This can lead to jerky motion of the upper platen, resulting in poor high speed cutting performance. Therefore, improvements are needed to ensure accurate, uniform, and smooth closure between the top and the bottom platens of a trim press in order to ensure high speed and accurate cutting capabilities suitable to enable use of the trim press with a modern thermal-forming machine. Furthermore, improvements are needed to enhance cutting performance, by reducing imbalance forces created by the moving upper platen, while minimizing the required support structure of the machine.

Another problem results from the speed limitations imposed when using traditional servo motor driven feed wheels to feed the web of material into the trim press. As the servo speed approaches 200 revolutions per minute (rpm), the feed wheels on each edge of the web can actually rip the web because the web is not strong enough to overcome the weight of the material in the web. One prior art technique has involved the use of pairs of wheels on each edge of the web, one (a drive wheel) having a plurality of circumferentially spaced apart and radially extending picks which perforate the web along each edge, to engage the web and enable feeding there along, and the other acting as a follower wheel. However, such constructions tend to tear the web, and are not capable of producing speeds necessary to exceed 160 cycles per minute (cpm). In fact, to feed a web of material into a trim press that is running at 400 cpm, the servo motor and wheels will run at about 2,000 rpm. Therefore, additional improvements are needed in order to enable the feeding of a web of plastic material into an improved high speed trim press.

The objective of the present invention is to provide a vastly improved machine trim press having features for reducing the dynamic operating forces and to enable high speed feeding of a web of plastic material into the trim press. Furthermore, features are desired for offsetting undesired dynamic imbalance forces in an operating trim press while at the same time producing smooth axial cutting forces, resulting in precise and accurate cutting of articles from a web of material during a forming operation, such as a thermal-forming cycle of a thermal-forming machine.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
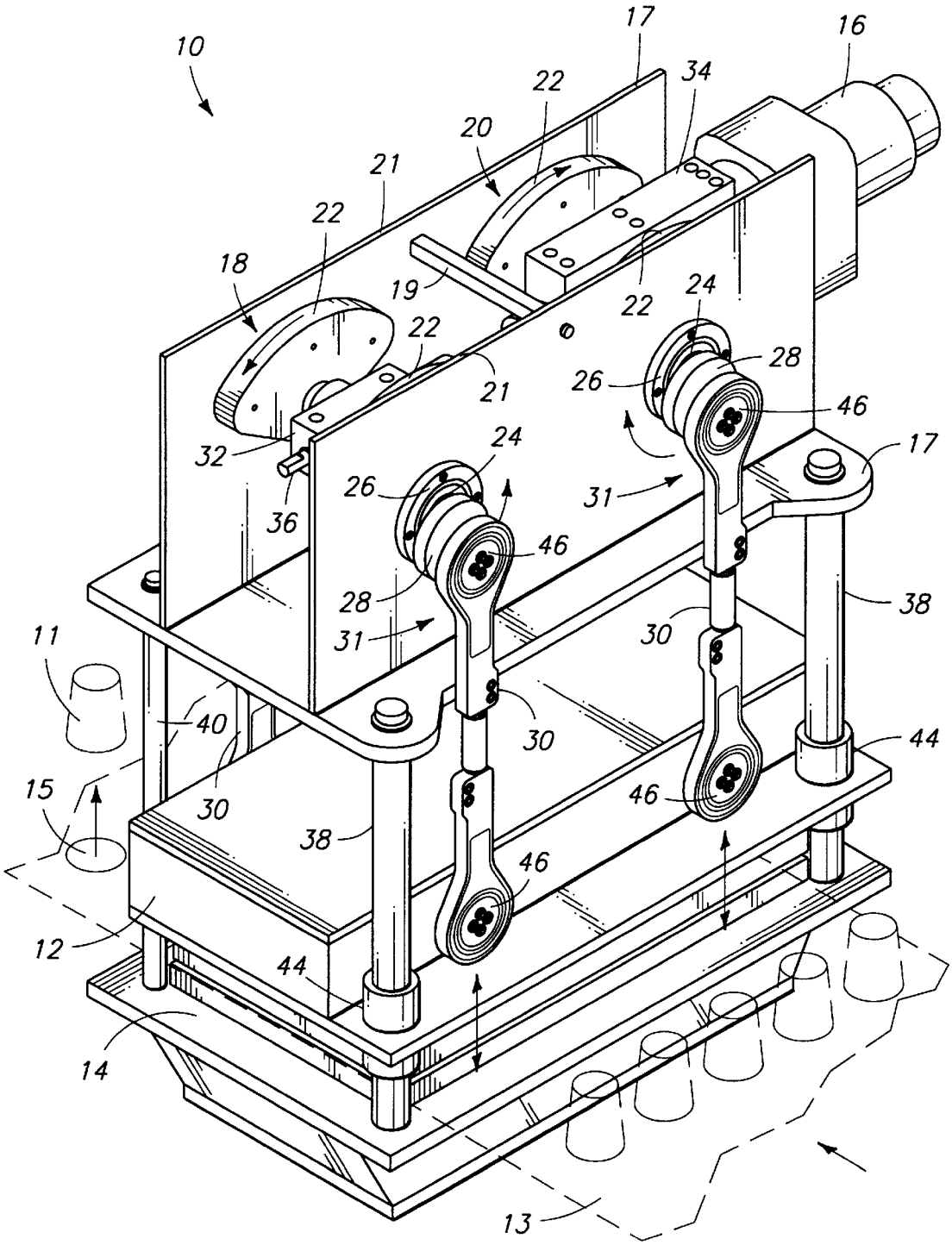
FIG. 1 is a schematic perspective view of a machine trim press having counterbalance features in accordance with a preferred embodiment of the invention.

This disclosure of the invention is submitted in furtherance of the constitutional purposes of the U.S. Patent Laws "to promote the progress of science and useful arts" (Article 1, Section 8).

In accordance with one aspect of this invention an improved trim press is taught for use in separating molded articles from a web of material. The trim press includes a frame, a drive motor carried by the frame, a first platen carried by the frame, and a second platen carried by the frame and configured to be moved in reciprocation relative to the first platen. A first flywheel assembly is provided on the trim press having a weight with an eccentric mass, the weight being driven in rotation by the motor and coupled to drive the second platen via at least one kinematic linkage. The trim press also includes a second flywheel assembly having a weight with an eccentric mass, the weight being driven in rotation by the motor and coupled to drive the second platen via at least one kinematic linkage. In operation, the first flywheel assembly and the second flywheel assembly are constructed and arrange such that the eccentric mass of the associated weight on the first flywheel assembly is positioned in mirror image with the eccentric mass of the associate weight of the second flywheel assembly, the first and the second flywheel assemblies being driven in counter rotation so as to substantially cancel out dynamic forces produced out of the axis of movement of the movable platen.

In accordance with another aspect of this invention an improved trim press usable for severing formed articles from a web of material is taught. The trim press includes a frame and a drive motor carried by the frame. The trim press also includes a first platen carried by the frame and having a first cutting feature, and a second platen movably carried by the frame and having a second cutting feature configured to coact with the first cutting feature. The second platen is configured to be axially reciprocated relative to the first platen, causing the first and the second cutting features to open and close so as to cut a web of material positioned therebetween. Furthermore, the trim press includes a flywheel assembly having an output shaft driven in rotation by the motor and a weight having interlocking features for mounting the weight on the shaft for rotation. The weight is mounted in mated engagement with the shaft such that mass of the weight is offset from the center of rotation, the shaft being coupled to drive the second platen via at least one kinematic linkage.

A preferred embodiment of an improved machine trim press is generally designated with the reference numeral 10. According to FIG. 1, an array of cups 11 are formed in a web of thermo-formable plastic material 13 by a thermal forming machine (not shown). Web 13 is intermittently fed between an upper platen 12 and a lower platen 14 by a conveyor (not shown) which intermittently progresses the web through a molding machine where cups are formed in the web, and into position between the trim press platens 12 and 14 where the cups are severed from the web. The conveyor preferably comprises a dual servo motor driven roller feed assembly, to be discussed in greater detail below with reference to FIGS. 3 and 8. Once web 13 is clamped against the upper platen via a spring-biased clamp (not shown) on the lower platen, such as a stripper carried by the lower platen 14, the platens can be completely closed together by press 10, severing the articles 11 from web 13. A parts handling machine (not shown) is carried by the frame of the trim press, along the exit side, for removing and stacking articles as they are severed from web 13. After removing each article 11 from web 13, a hole 15 is left in the scrap portion of web 13. The resulting scrap portion of web 13 is then forwarded into a recycling, or pulverizing machine where it is shredded and recycled. Details of one exemplary recycling machine are disclosed in U.S. Pat. No. 4,687,144, "Apparatus for Comminuting Waste Materials", hereby incorporated by reference.

Details of one exemplary thermal-forming machine are disclosed in U.S. patent application Ser. No. 08/632,930, "An Improved Mold Assembly and Seal Arrangement for Use With A Thermo-Forming Machine", listing Jere F. Irwin, Gerald M. Corbin, and Dale L. Vantrease as inventors. This patent application and resulting patent are hereby incorporated by reference as if fully included herein.

In operation, a servo motor 16 carried on an upper frame 17 of press 10 drives a pair of flywheel assemblies 18 and 20, each in a counter rotating motion relative to the other. A cross member 19 retains a pair of substantially parallel plates 21 on frame 17 in rigid spaced apart relation for carrying assemblies 18 and 20. Four, vertical rail members (not shown) secure upper frame 17 to platen 14, and further support a perforated steel mesh cage (not shown) about press 10 for protecting operators from injury during use.

Each flywheel assembly 18 and 20 forms a rotating eccentric mass having a center of gravity that is offset from its axis of rotation. The rotating mass of each assembly 18 and 20 are driven so that dynamic forces produced from the rotation of each eccentric mass is additive in the direction of motion of the upper platen 12, and substantially cancels out (or counterbalances) in all other directions within the rotating plane of the masses. A pair of weights 22 on each assembly 18 and 20 are securely mounted to the assembly eccentrically of their axis of rotation to form the eccentric, or offset mass. When spun, the offset weight of each mass produces dynamically imbalanced rotational forces that would normally impart centrifugal forces to press 10. However, since the pair of weights 22 in each assembly 18 and 20 are configured to be spun in counter rotating relation, they substantially cancel out the imbalance forces in all directions other than the direction of motion for upper platen 12.

As a result of the above, the counter rotating motion of assemblies 18 and 20 produces a net axially reciprocating imbalance force acting in the direction of motion of upper platen 12. Preferably, the weights are sized and positioned so that the resulting axially reciprocating force substantially cancels out an axially reciprocating force produced by the reciprocating motion of upper platen 12, including associated crank arm assemblies. When platen 12 reaches its lower most position, the resulting centrifugal forces from the flywheel assemblies are greatest, which offsets forces produced by the moving upper platen 12. Likewise, when platen 12 reaches its highest most position, the resulting centrifugal forces from the flywheel assemblies is greatest, which offsets forces produced by the moving upper platen 12. Such produces highly desirable substantially balanced dynamic forces that assist in smoothly and evenly cutting a web of material as it is intermittently passed between platens 12 and 14. Hence trim press 10 is highly balanced, enabling faster operating speeds. Furthermore, the overall mass of the flywheel assemblies can be reduced, while still producing a smoothly operating press 10.

Even more importantly, the cancellation of any dynamic flywheel forces off-axis from the direction of motion of platen 12 results in a smooth reciprocating motion of platen 12. In this manner, the need to provide a large number of highly enforced guide members to ensure an accurate cutting operation is reduced, or even eliminated. Essentially, the drive assembly that reciprocates platen 12 also serves to align the platen, while press 10 still produces the necessary dynamic cutting forces for offsetting forces produced by moving platen 12 via the coaction of the flywheel assemblies.

In this manner, smooth dynamic cutting forces can be produced with a balanced press design that is relatively light in weight, has reduced vibration, and does not require substantial vertical guide support to maintain smooth axial reciprocation of the upper platen during operation. In contrast, prior art devices have required the use of four large vertical guide supports and guide bushings, one pair being provided at each corner of the movable platen.

Flywheel assemblies 18 and 20 are each formed from an output shaft 24 which is supported for rotation at either end by a rotating bearing assembly 26. A throw arm 28 is fixedly mounted to each end of each shaft 24 to form a drive arm for driving platen 12 in vertically reciprocating motion. Throw arm 28 is driven in rotation by the shaft, which in turn is driven by drive motor 16. The radial outermost end of each arm 28 is pivotally mounted to a platen connecting rod 30, along an upper end portion. A lower end portion of rod 30 is then pivotally mounted to platen 12. In this manner, rod 30 and throw arm 28 form a crank arm assembly 31 that drives platen 12 in reciprocating motion, at each corner. By rotating shafts 24 in synchronized fashion, with throw arms 28 being positioned in opposed symmetric relation, platen 12 can be caused to move vertically with single degree of freedom motion such that its contact surface remains substantially parallel with lower platen 14 throughout a cycle of operation. Such ensures parallel and even closure between the platens, greatly reducing wear between cutting surfaces carried by the upper and the lower platens 12 and 14, respectively.

Motor 16 is formed from a servo driven alternating current (AC) motor that has built-in encoders for monitoring the position of the drive shaft. In this manner, motor 16 of FIG. 1 can be computer controlled so as to accurately drive reciprocation of upper platen 12 in relation to forward positioning of web 13 by a separately driven servo motor feed conveyor (not shown), which is also computer controlled. Even further, a thermal forming machine (not shown) provided upstream of press 10 forms articles 11 in the web via a similar computer controlled servo driven motor device. Preferably, a single, common computer controls and choreographs operation of the thermal forming machine, conveyor and press 10. One suitable servo drive motor is presently sold by Siemens AG of Germany, under the trade name of SIMODRIVE 611-A, and includes transistor PWM inverters and motors for AC feed drives. The associated servo driven motors and computer use a high speed digital signal processor running at 40 MHz (40 million cycles per second) or more, which can interrogate 2,500 encoder pulses per revolution when the motor is running at 2,000 rpm. Such processing speeds enable the computer and drives of each machine to react within one encoder pulse after receiving a registration signal from the product being fed. Such servo motors comprise high speed, brushless servo motors that are capable of running at speeds unattainable with previous technology. Hence, trim press speeds and web feeding speeds need to be improved according to the aspects of this invention. Further details will be discussed below with reference to FIGS. 3 and 8.

Drive motor 16 is mounted to frame 17 such that its output shaft drives a pair of coupled together input shafts 36 on gearbox assemblies (or transfer cases) 32 and 34 for driving flywheel assemblies 18 and 20, respectively. The inputs shafts 36 of each gearbox assembly 32 and 34 are configured in substantially collinear relation with the drive shaft of motor 16. An output shaft 24 extends through each gearbox assembly 32 and 34, where bevel gears couple each input shaft 36 with each associated and perpendicularly extending output shaft 24. An outermost end of input shaft 36 on assembly 18, positioned opposite motor 16, has a pair of flat surfaces configured to receive a wrench so as to enable rotation of the shaft during repair, maintenance and servicing.

To further ensure accurate axially reciprocating motion of platen 12 relative to stationary platen 14, a pair of primary guide posts 38 are fixedly mounted between upper frame 17 and platen 14, along the web entry side of press 10. As shown in FIG. 1, a pair of secondary guide posts 40 are similarly fixedly mounted between upper frame 17 and platen 14. Posts 38 and 40 also serve to support upper frame 17 on lower platen 14. Yet another secondary guide post 42 (see FIG. 2) is mounted on frame 17, above plate 12, and along the web exit side of press 10. Primary guide posts 38 slidably receive a bronze bushing assembly so as to axially guide platen 12 along guide posts 38. Bushing assemblies 44 each contain a porous bronze bushing configured to retain a supply of lubricating grease. Furthermore, bushing assemblies 44 and posts 38 are accurately sized and positioned so as to ensure accurate axial alignment between platens 12 and 14.

In contrast, secondary guide posts 40 and 42 serve primarily to guide and support a part handling machine (not shown) that is configured to remove and stack articles as they are cut from web 13, as well as to guide the exiting scrap portion of web 13 into a recycling machine. Hence, posts 40 are sized significantly smaller than posts 38, and for certain applications, don't even receive any bushing assemblies for attaching to platen 12. Optionally, posts 40 can receive downsized bushing assemblies for providing additional axial support and guidance, but accurate dimensional tolerancing is not necessary over that already provided by posts 38 and bushing assemblies 44 as a result of the construction of this invention.

According to the construction of FIG. 1, platen connecting rods 30 are each formed from a pair of forged aluminum arms that are connected together with a threaded rod. Each rod is threaded at each end so as to provide adjustment of the length of the rod when aligning upper platen 12 during set up relative to lower platen 14. Each arm receives a pair of threaded fasteners to fixedly receive the rod into each arm, locking the overall length of rod 30 to the desired threadingly adjusted length. Furthermore, each arm in assembly receives a bearing assembly which facilitates pivotal mounting of each end of rod 30 to an associated throw arm 28 and platen 12, respectively.

Figure 2:
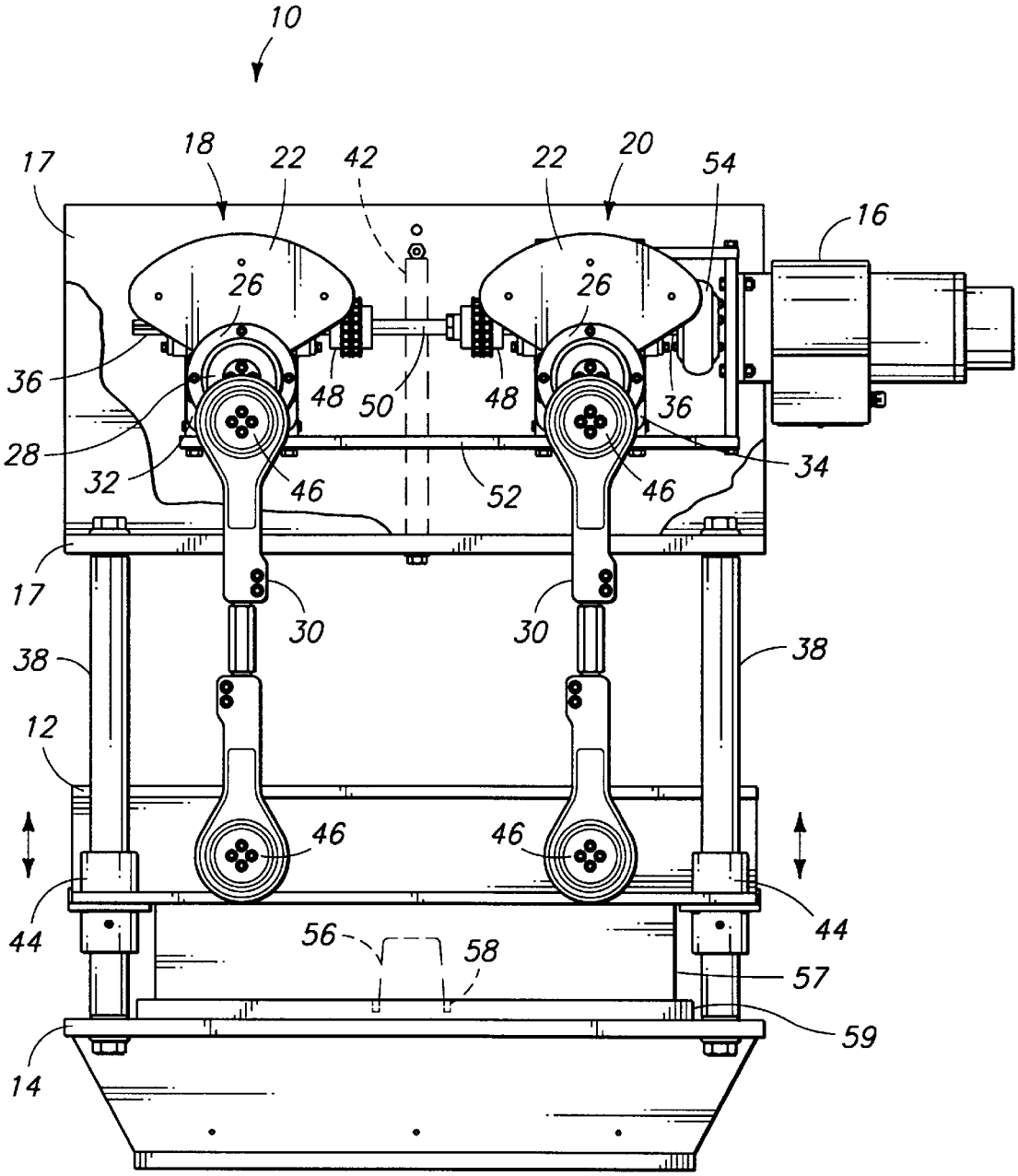
FIG. 2 is a vertical front view of the trim press taken along the input feed direction of the web of material, and illustrating the upper platen lowered into contact with a contact plate of the lower platen.

FIG. 2 illustrates trim press 10 in a vertical front view with the front plate of frame 17 partially broken away in order to view the mounting relationship between motor 16 and flywheel assemblies 18 and 20. Platen 12 is shown in a lowered, or closed position on the die frame of platen 14. In this view, the collinear relationship of motor 16 and its drive shaft with the input shafts 36 on assemblies 18 and 20 can be clearly seen. Input shafts 36 for each assembly 18 and 20 are joined together with a pair of chain couplings 48 and an extension shaft 50. A sub-frame 52 mounts the gear boxes 32 and 34 together in spaced apart relation, supporting them within frame 17. Additionally, sub frame 52 mounts to motor 16, supporting it at one end in fixed relation with the pair of gear boxes 32 and 34. The entire resulting assembly is then supported within frame 17 via the pairs of bearing assemblies 26 and the gear box output shafts. The output shaft of motor 16 is then connected with the gear box input shafts 36 (and extension shaft 50) via a coupling connector 54.

According to the construction of FIGS. 1 and 2, platens 12 and 14 each removably carry a die member 57 and 59, respectively, which forms part of each platen. The die members 57 and 59 each contain a plurality of associated male and female cutting features 56 and 58, respectively, which coact to sever articles from the web of material while it is positioned there between. Accurate placement of the web and molded articles via a computer controlled servo motor driven conveyor (see FIG. 3) and operation of trim press 10 via computer controlled motor 16 allows for accurate cutting of articles from the web via coaction of features 56 and 58. Preferably, male cutting feature 56 comprises a circumferential steel ring, lowered below the bottom die surface, and a clearance cavity or channel 98 (see FIG. 7) which receives trimmed product after it has been severed between the platens 12 and 14. Similarly, female cutting feature 58 comprises a receiving slot, or lowered surface having an edge that coacts with the ring of feature 56, creating a scissors action that severs the web therebetween. Preferably, a spring loaded stripper forms the lowered surface, as the male cutting feature engages the stripper, enabling cutting of the web and subsequent removal of the web from the lower platen (see FIG. 7).

Figure 3:
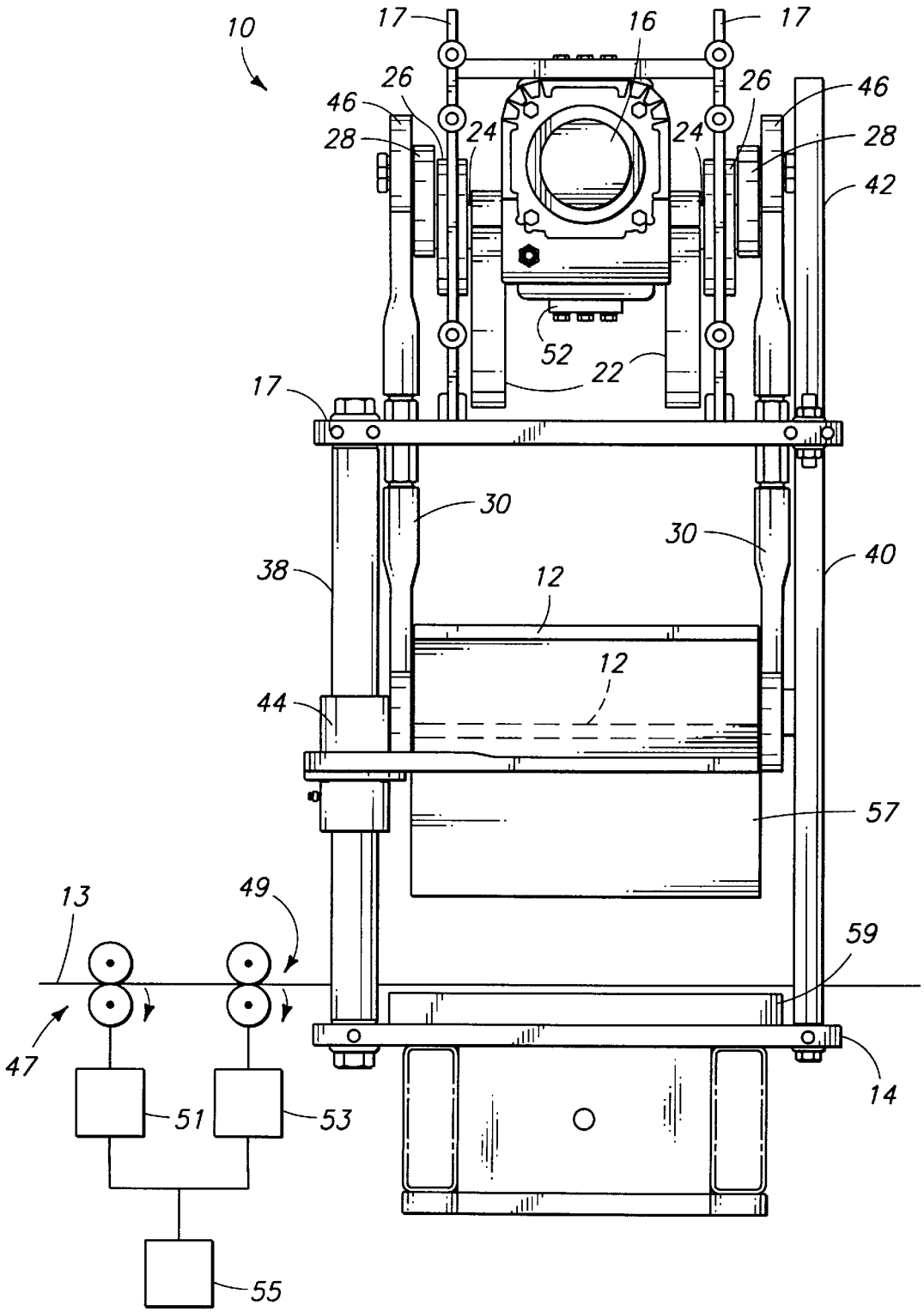
FIG. 3 is a vertical side view of the trim press of FIGS. 1 and 2 taken from the right side of FIG. 2 illustrating the upper platen raised from the lower platen and a dual servo motor driven roller feed assembly.

FIG. 3 shows a vertical side view of the trim press taken from the right side, as viewed in FIG. 2. Accordingly, the raised position of platen 12 can be clearly seen, with throw arms 28 rotated upwardly so as to present platen 12 at its highest most position. Also shown in dashed lines is the lowest most, or lowered position of platen 12, corresponding with throw arms 28 being rotated downwardly to a vertically lowered orientation. Additionally, the secondary contribution of posts 40 and 42, which serve primarily to mount a parts handling machine, can be clearly seen. Optionally, a pair of small bushing assemblies, similar to bushings 44 can be added to platen 12 for slidably guiding it along posts 40. However, their contribution for ensuring axially accurate reciprocation of platen 12 is not necessary according to the machine vibration-reducing improvements of this invention resulting from counter rotating the flywheel assemblies via four kinematic linkages, in the form of crank arms 31 (see FIG. 1). A plurality of threaded bolts and washers are also shown along the edge of plates 21 for affixing frame 17 to the vertical frame members (not shown) that support upper frame 17 atop platen 14 and further serve to carry a protective cage about press 10.

FIG. 3 also depicts a conveying mechanism comprising a dual servo motor driven roller feed assembly for intermittently feeding web 13 through press 10. Preferably, two sets of side-by side pairs of roller assemblies 47 and 49, are provided along each of the outer, or free edges of web 13 so as to not interfere with articles formed in the web. A pair of servo driven motors 51 and 53 each drive a set of the side-by-side left and right edge roller assemblies, the first set 47 of left and right roller assemblies pulling web 13 from a thermal forming machine (not shown) toward press 10, and the second set 49, or pair of left and right roller assemblies assisting the first set in pulling web 13 from press 10 at high speed. In this manner, web 13 can be fed at a much higher speed from between platens 12 and 14, greatly increasing the achievable cycle speed of press 10. In some cases, slop or excess web material can be accommodated between the pairs of roller assemblies, depending on the operating conditions.

Each set of roller assemblies 47 and 49 are formed from a pair of left and right roller assemblies, each assembly having a drive wheel and a follower wheel. The drive wheel is formed from an aluminum wheel which is anodized and has a sandpaper radial outermost finish. The idler, or follower wheel is formed from a neoprene wheel that is forced into biased engagement with the web and drive wheel via one or more air cylinders (not shown). In this manner, the drive wheel forms a grippy wheel that engages and drives the web along a corresponding outer edge. The side-by-side set of roller assemblies 47 forms a feed servo mechanism, powered by brush-less servo motor 51. Similarly, the side-by side pair of left and right roller assemblies (one on the left edge of the web and one on the right edge of the web) of roller assemblies 49 forms a helper servo mechanism, powered by brush-less servo motor 53. Additionally, a third pair of roller assemblies (not shown) can be provided on the exit side of press 10 to facilitate feeding of scrap web into a recycling machine. Both the feed servo mechanism and the helper servo mechanism are directed under computer control via computer controller 55. Motors 51 and 53 are preferably constructed and run according to details of the previously disclosed motor 16 (of FIG. 1).

In order to computer choreograph the cycle speed of press 10 in matched relation with the position of web 13, the servo drive motors are coupled with a servo motor controller 55 and a machine-based computer system. Controller 55 serves to maintain the conveying of web 13 in synchronization with an adjacent thermal forming machine (not shown), and with operation of press 10. Hence, press 10 is able to maintain an accurate cutting of a lip-edge of web material about each article molded into web 13. By providing a helper servo mechanism, the web can be fed fast enough to allow the trim press to run (at 400 cpm) a row of molded cups with substantially perfect registration. Such occurs without causing the web to rip along the edges. Therefore, higher speeds can be attained with an additional servo feeding mechanism that is feeding the final servo mechanism but with a somewhat less radical movement in order to help the first (feed) servo mechanism to accomplish its high speed, accurate feed without having to overcome the resistance of the weight of the complete web. If the combination of a feed and a helper servo mechanism are not used, then as servo feed speeds approach 200 rpm, the feed wheels can actually rip the web because the web is not strong enough to overcome the weight of the material in the web. Together, the feed and helper servo mechanisms enable the trim press 10 to accommodate the increased production of modern thermal forming machines. Hence, motor speeds of 2,000 rpm with 2,500 encoder pulses per revolution on the conveyor are possible, enabling full use of modern high speed digital signal processing capabilities running at processing speeds of 400 MHz or more.

Figure 4:
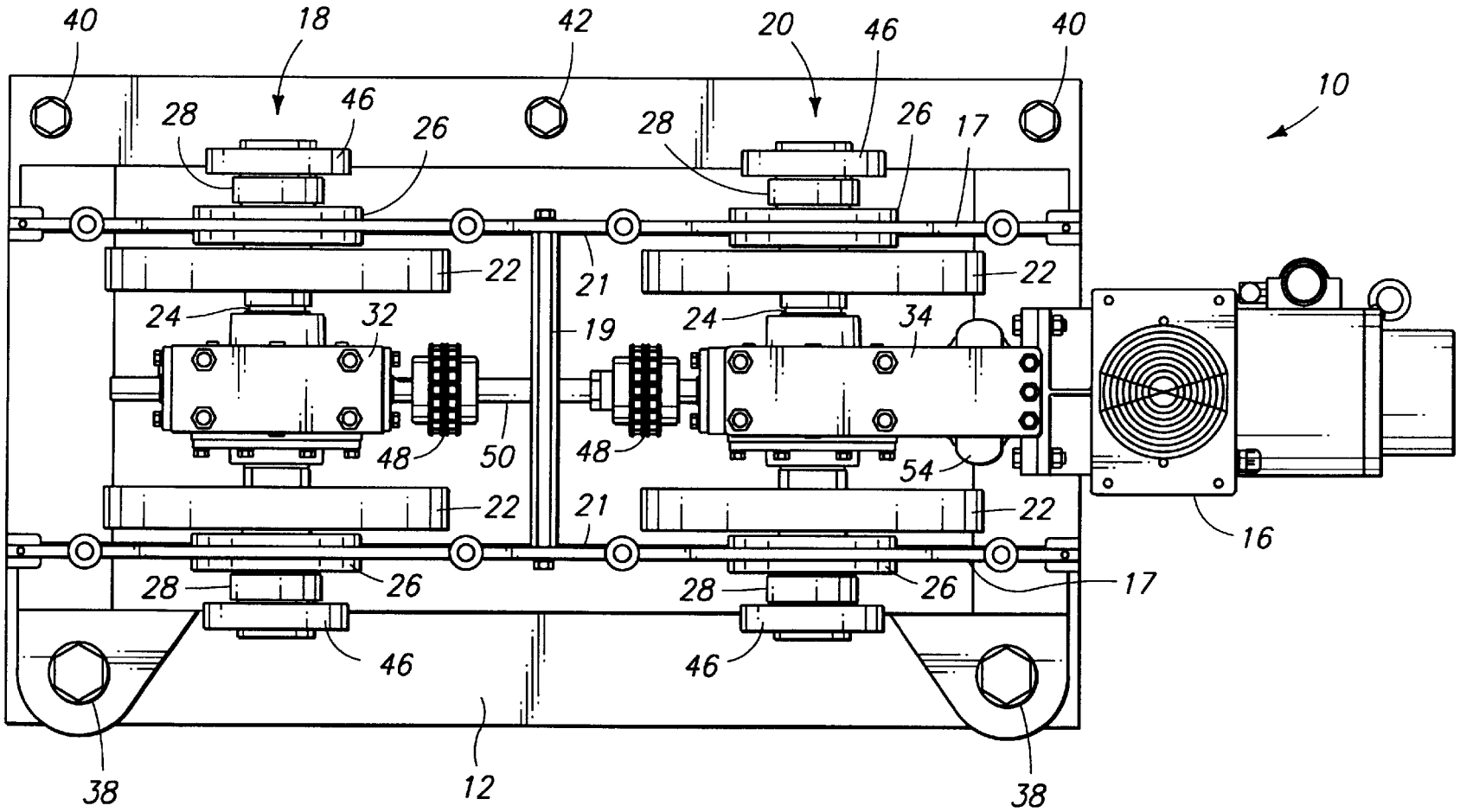
FIG. 4 is a plan view of the trim press illustrating further the layout of the motor, drive assembly and counterbalance features.

FIG. 4 illustrates in plan view the layout of trim press motor 16, the drive assembly formed by gear boxes 32 and 34, extension shaft 50, and chain couplings 48, and the counterbalance features of flywheel assemblies 18 and 20. A plurality of threaded bolts and washers are shown along the top edges of plates 21 for affixing frame 17 to cross members that extend from the vertical frame members (not shown), supporting upper frame 17 atop platen 14, and carrying a protective cage about press 10. According to the position depicted in FIG. 4, weights 22 are shown rotated in a vertically raised orientation. By sizing the weights so that they match, it becomes easy in FIG. 4 to visualize the cancelling out of imbalance forces in directions not collinear with movement of platen 12 caused by counter rotating the weights 22 on assemblies 18 and 20.

Figure 5:
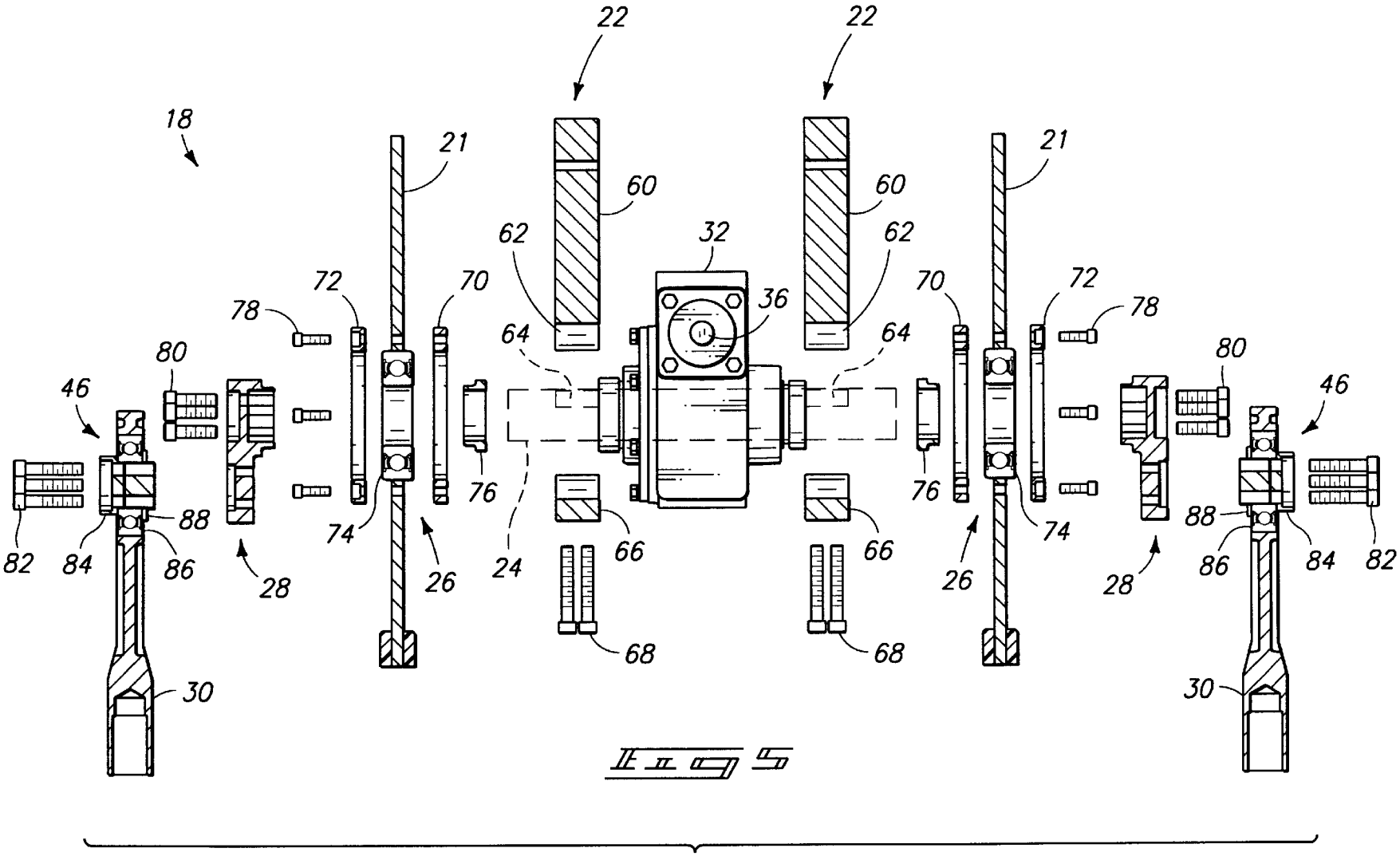
FIG. 5 is an exploded vertical cross-sectional view taken generally along line 5—5 of FIG. 4 illustrating the construction of one of the counterbalance shaft assemblies.

FIG. 5 illustrates an exploded vertical cross-sectional view of one of the counter-balanced flywheel assemblies, namely flywheel assembly 18. Shaft 24 is shown is dashed lines, and forms part of gearbox 32 wherein a pair of bevel gears connect shaft 24 with input shaft 36. One of weights 22 is mounted securely to shaft 24, on each side of gear box 32. Shaft 24 is then received through one of the bearing assemblies 26 as carried within an aperture of each plate 21, on each side. One of throw arms 28 mounts to each end of shaft 24 for driving the upper platen via one of the platen connecting rods 30. To promote relative rotation between each throw arm 28 and rod 30, a bearing assembly 46 is provided therebetween where they affix to one another. Flywheel assembly 20 is similarly constructed.

More particularly, each weight 22 is formed from a tear drop shaped weighted member 60 having a mounting notch 62 that is constructed and arranged to mate in interlocking engagement with a complementary pair of flat faces formed in shaft 24. Preferably, each member is formed from one or more pieces of thick plate steel. Preferably a pair of faces formed at ninety degrees to one another are provided on the shaft, for mating with notch 62. Other shaft surfaces and notch shapes which interlock are possible. A clamping collar 66 having a substantially semi-circular mating face engages with shaft 24 in assembly, along a side opposite faces 64, ensuring positive interlocking engagement between weighted members 60 and shaft 24. A plurality of threaded fasteners, such as bolts, secure collar 66 to member 60, trapping shaft 24 securely therebetween. Such a construction creates a strong and durable shaft mount for retaining each eccentric mass 22 to shaft 24.

With the substantial resultant dynamic imbalance forces that eccentric weights 22 can together produce when placed in high speed rotation, the mounting features of this invention allow one to operate a trim press at higher speeds while minimizing the flywheel mass needed to produce forces that substantially offset dynamic forces produced by reciprocating movement of upper platen 12. This leads to a smooth rotational velocity of each shaft supporting each rotating weight. Therefore, the resulting trim press is better able to keep up with the decreasing cycle times found on modern computer controlled thermal forming machines, allowing for increased production rates that accommodate the enhanced web conveying features of this invention. Even further, web cutting accuracy is maintained, while at the same time smooth cutting forces are produced by the movement of the eccentric flywheel via the counter rotating assemblies which cancel out imbalance forces produced in directions not collinear with the axis in which the upper platen is moving, and cancel out dynamic inertial forces produced from the moving (reciprocating) platen.

As shown in FIG. 5, each bearing assembly 24 is formed by a multiple piece construction providing a bearing 74 that is mounted within an aperture in plate 21 of the press upper frame. An inner retaining collar 70 and an outer retaining collar 72, respectively, of the assembly retain bearing 74 within the aperture of plate 21. A plurality of threaded fasteners 78 secure collar 70, plate 21 and collar 72 together, retaining bearing 74 therebetween. A press fit support sleeve 76 is then received over shaft 24, and press fit within the inner race of each bearing 74, forming a snug and centered rotatable support for shaft 24 within plates 21.

Further according to FIG. 5, throw arms 28 are each mounted to opposite ends of shaft 24 with a plurality of threaded fasteners 80. An aperture in throw arm 28 receives an end of shaft 24 snugly therein. A plurality of complementary threaded female bores are formed within each end of shaft 24 for receiving fasteners 80 therein in assembly. In this manner, arm 28 is securely fixedly mounted to shaft 24, producing a very strong torsional fixturing between arm 28 and shaft 24. Such a mounting is necessary in order to accommodate the dynamic forces produced while operating the trim press.

Even further according to FIG. 5, bearing assemblies 46 are retained within a bore in each arm 30 via a plurality of threaded fasteners 82 and a shouldered mounting post 84. Each bearing assembly includes the post 84, fasteners 82, a bearing 86 and a face mounting ring 88. Ring 88 seats between the inner race of bearing 86 and an outer shoulder on arm 28, forming contact surfaces therealong. Accordingly, each bearing assembly 46 mounts an associated platen connecting rod 30 in rotatable relation with an associated throw arm 28, the throw arms being driven in rotation via shafts 24 and 36 by the servo drive motor 16 (see FIG. 4).

Figure 6:
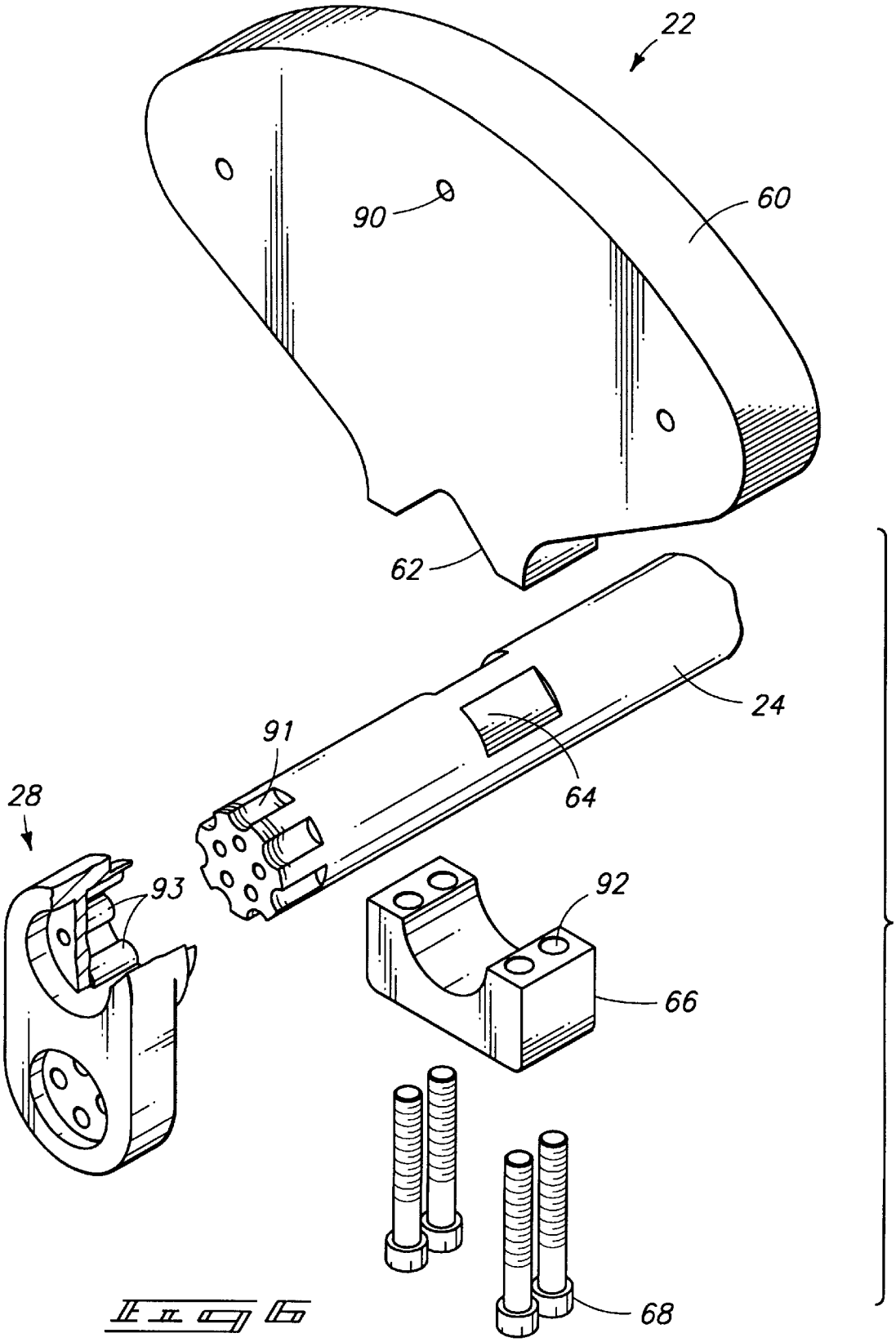
FIG. 6 is an exploded perspective view of one of the counterbalance weights of the trim press illustrating mounting features for attaching the weight to the drive shaft.

FIG. 6 shows an exploded perspective view of one of the counterbalanced flywheel weights 22 of the trim press of FIGS. 1–5 illustrating mounting features for attaching each weight 22 to the associated drive shaft 24. Accordingly, the notch 62 provided in weighted member 60 and its interlocking association with faces 64 of shaft 24 when assembled can be clearly seen. By securely threading fasteners 68 through clearance apertures 92 of collar 66 and into complementary threaded bores of member 60, weight 22 is securely retained onto shaft 24, preventing any relative rotation therebetween. Such a construction has proven rugged and durable, and necessary in light of the considerable imbalance forces that are produced when spinning the eccentric mass of weight 60 about shaft 24, particularly when done at a high rate of rotational speed. Alternative constructions which lack physical interlocking features between weight 60 and shaft 24 have proven ineffective for long term use because of these large forces, including the use of through pins or bolts which extend through a bore in shaft 24 and into weight 60. Additionally, each end of shaft 24 is secured to each throw arm 28 via mating spline features 91 and 93, respectively, and threaded fasteners (not shown). Weight 60 also includes a plurality of apertures 90.

Figure 7:
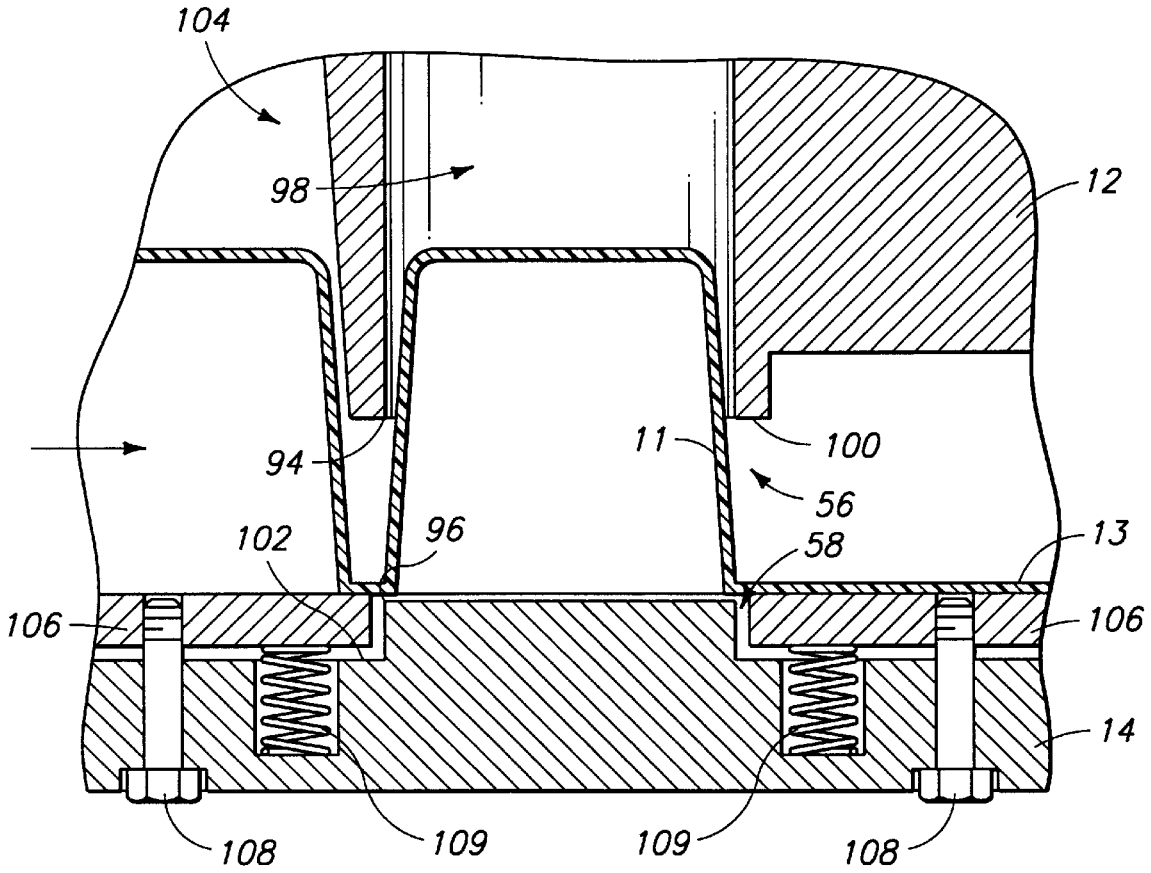
FIG. 7 is a vertical centerline sectional view of one of the pair of cutting features formed in the top and the bottom platens of the trim press illustrated in FIGS. 1–6 including a web stripper.

FIG. 7 illustrates a vertical centerline sectional view of one exemplary pair of cutting features 56 and 58 formed in the die members of the top and bottom platens 12 and 14, respectively, of trim press 10. Such features 56 and 58 are configured for cutting a cup 11 away from web 13 in which it has been thermal formed. Many alternative configurations are possible for cutting any of a number of differently shaped articles from a web of material. Similarly, the web of material can be formed from a thermo-formable plastic, metal, foam or any of a number of die and heat formable webs of material.

According to FIG. 7, male cutting feature 56 has a ridge, or ring 100 which forms a circumferentially extending cutting edge 94, and a clearance cavity, or channel 98 for enabling clearance of cup 11 during a cutting and severing operation as the press is closed thereon. Channel 98 receives the trimmed product where it is either stored, or directly removed from another end. Portions 104 of platen 12 separate adjacent channels 98. Female cutting feature 58 has a recessed portion 102 which forms a complementary circumferentially extending cutting edge 96. A stripper comprising one or more stripping plates 106 is movably supported within recessed portion 102. Edges 94 and 96 coact to sever web 13 about cup 11, leaving a radially outwardly extending flange about cup 11. Normally, the resulting flange is rolled back toward the body of the cup via a secondary, and subsequent thermal forming operation, forming a smooth rolled lip edge that is more compatible with a user's lips and mouth. Preferably, features 56 and 58 are formed in die members 57 and 59 of platens 12 and 14, respectively, the die members being removably mounted with the platens to facilitate quick and easy changing of the cutting features to suit particular desired forming and cutting operations.

Stripper plate 106 is carried in a spring biased elevated position via springs 109. A plurality of shoulder bolts 108 limit the maximum raised position of the plate, slightly above the top surface of the die. As ridge 100 engages web 13 and plate 106, plate 106 is downwardly biased, enabling edges 94 and 96 to coact and sever the web. Subsequently, as platen 12 is raised, stripper plate 106 raises via springs 109 to ensure release of severed web 13 from around edge 96 of lower die 14. Such prevents catching of web 13 on lower platen 14, allowing for continued and uninterrupted subsequent operating cycles. Furthermore, plate 106 acts as a spring biased clamp to secure web 13 during cutting of web 13.

Figure 8:
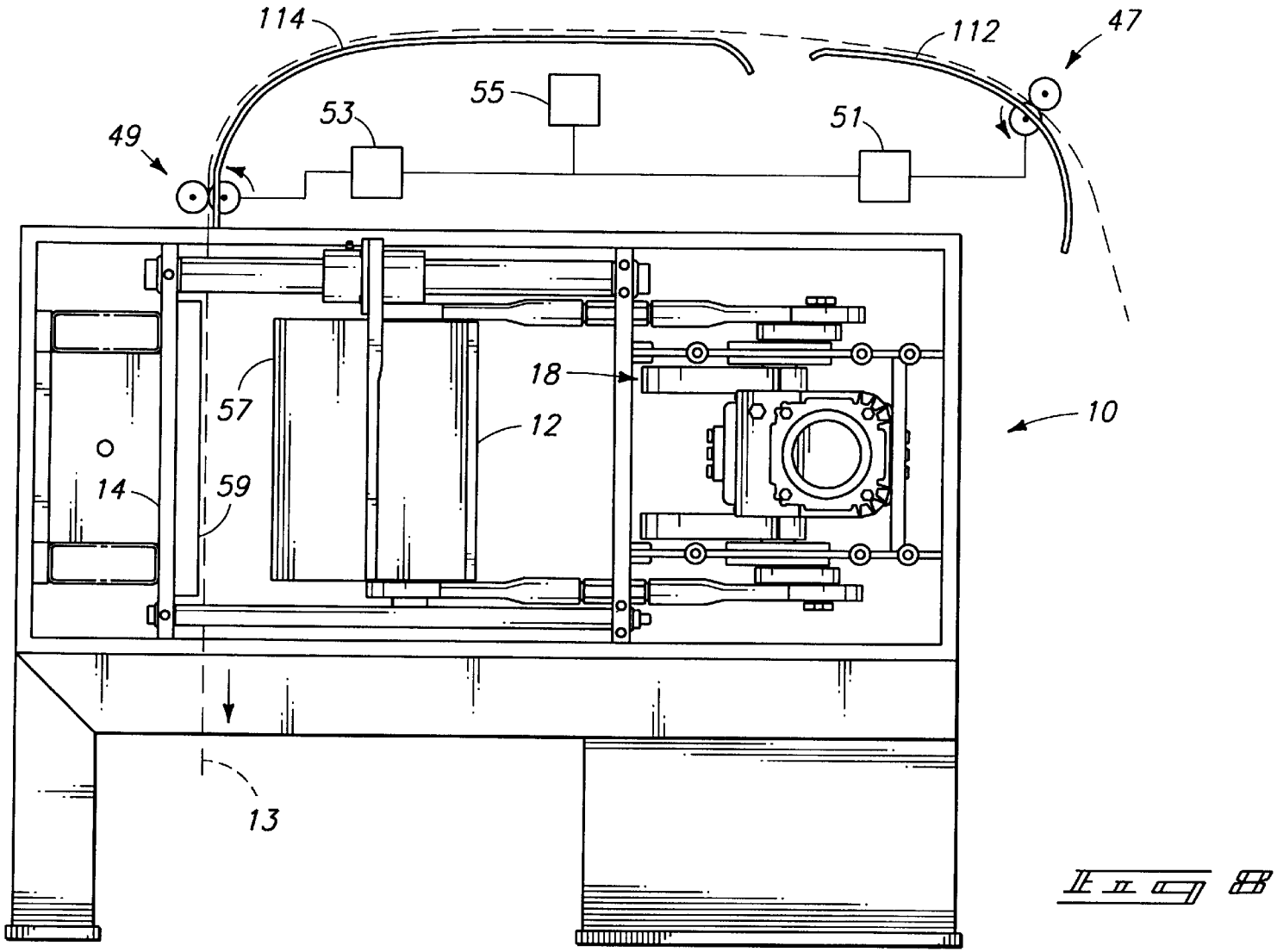
FIG. 8 is a vertical side view of an alternatively configured trim press of this invention taken from a side corresponding to that shown in FIG. 2 and illustrating a horizontally configured trim press having a dual servo motor driven roller feed assembly.

FIG. 8 illustrates an alternatively configured trim press of this invention taken from a side corresponding to that shown in FIG. 2 and illustrating a horizontally configured trim press 10 having a dual servo motor driven roller feed assembly. Trim press 10 is the same as press 10 of FIGS. 1–7, except the mounting frame is configured to support the press in a horizontal position. A conveyor assembly is also mounted atop the frame for feeding a web 13 into the press where formed articles are trimmed from the web. The conveyor assembly runs just like the conveyor of FIG. 3, except for the horizontal arrangement of press 10. However, to support web 13 for feeding via a feed servo mechanism and a helper servo mechanism, a leading pair of edge supports 112 and a trailing pair of edge supports 114 guide and support web 13 along each edge so that the two sets of side-by side pairs of roller assemblies 47 and 49 can feed web 13 at high speed into press 10. Similar to FIG. 3, servo motors 51 and 53 are controlled and choreographed via computer controller 55. By providing servo driven wheels at the edges of the web, the web is driven only along the edge, and the web is not damaged by pick fingers (as used in the prior art). By including an optical product sensor, the computer controller can locate the web and formed articles, enabling index length and product registration to be computer controlled, allowing for adjustment of the web on the fly. Hence, indexing is faster, so higher trim press speeds may be possible. Furthermore, many materials can be run through such a device, including foam, solid sheet, and film.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A trim press, comprising:

a stationary support structure including a stationary platen, a support frame, and a plurality of guideposts rigidly secured between the stationary platen and the support frame;

a movable platen supported between the stationary platen and the support frame and configured for guided axial reciprocating movement along at least two of the guideposts;

a drive train assembly carried by the support frame in spaced-apart relation with the at least two guideposts and including a drive motor, a drive shaft extending centrally of the support frame, a pair of output shafts extending transversely to the drive shaft, and a pair of transfer cases, each connected between the drive shaft and one of the output shafts;

a plurality of crank arm assemblies, each crank arm assembly connected between one corner of the movable platen and one of the output shafts; and a counterbalance assembly carried by the support frame and including a first pair of rotating counterbalance weights mounted eccentrically on one of the output shafts on either side of one of the transfer cases and a second pair of rotating counterbalance weights mounted eccentrically on the other of the output shafts on either side of another of the transfer cases;

wherein the drive train assembly and crank arm assemblies cooperate to drive the movable platen in reciprocation while the first and second pair of counterbalance weights are driven in counter-rotation so as to counterbalance the moving platen and crank arm assemblies and substantially counterbalance each other in directions off-axis to the moving platen.

2. The trim press of claim 1 wherein the stationary platen is rectangular, and the plurality of guideposts comprises four guideposts mounted between the support frame and the stationary platen and operative to rigidly secure the support frame to the stationary platen.

3. The trim press of claim 2 wherein the movable platen includes two bushings, and wherein each bushing is carried for slidable movement along a respective one of the guideposts such that the movable platen is further guided for axial reciprocation by two of the guideposts.

4. The trim press of claim 1 wherein the support frame comprises a pair of plates mounted in spaced-apart and parallel relation, each plate extending in a plane parallel to the guideposts, the drive train assembly supported at least in part between the two plates with the drive shaft extending between the plates, and the pair of output shafts journaled for rotation at each respective end by each plate.

5. The trim press of claim 4 wherein each pair of rotating counterbalance weights is further carried for rotation between the plates of the frame.

6. The trim press of claim 1 wherein the drive motor is carried by the support frame and configured to rotatably drive one end of the drive shaft.

7. The trim press of claim 4 further comprising a pair of bearing assemblies provided in each plate, one of the bearing assemblies in each plate cooperating to carry one of the output shafts and a second of the bearing assemblies in each plate cooperating to carry another of the output shafts, the pair of output shafts cooperating to support the pair of drive shafts, transfer cases, and output shaft by the frame.

8. The trim press of claim 1 wherein the trim press is a vertical trim press and the support frame is an upper frame.

9. A trim press, comprising:

a stationary support structure including a stationary platen, a support frame, and four guideposts extending between the stationary platen and the support frame, one guidepost associated with each corner of the stationary platen;

a movable platen supported for axial reciprocating movement between the stationary platen and the support frame and slidably guided by at least two of the guideposts;

a drive train assembly carried within the support frame at a location remote from the guideposts and including a drive shaft extending centrally of the frame, a pair of output shafts extending transversely to the drive shaft, and a pair of transfer cases, with one transfer case being connected between the drive shaft and each output shaft;

a drive motor carried by the support frame and coupled to drive the drive shaft in rotation;

four crank arm assemblies, each crank arm assembly connected at one end to one corner of the movable platen and at another end to one of the output shafts; and a counterbalance assembly carried by the frame and including a first pair of rotating counterbalance weights mounted eccentrically on one of the output shafts and a second pair of rotating counterbalance weights mounted eccentrically on the other of the output shafts, wherein each pair of weights is mounted outbound of one of the transfer cases;

wherein the drive train assembly and crank arm assemblies cooperate to drive the movable platen in reciprocation while the first and second pair of counterbalance weights are driven in counter-rotation so as to counterbalance the moving platen and crank arm assemblies and substantially counterbalance each other in directions off-axis to the moving platen.

10. The trim press of claim 9 wherein the support frame carries the drive train assembly and the counterbalance assembly above the guideposts and the stationary platen.

11. The trim press of claim 9 wherein the drive train assembly and the counterbalance assembly are housed within the support frame.

12. The trim press of claim 9 wherein each transfer case is mounted between one pair of the counterbalance weights.

13. The trim press of claim 12 wherein the support frame comprises a pair of plates mounted in spaced-apart and parallel relation, each plate extending in a plane generally parallel to the guideposts, wherein the drive train assembly is supported between the two plates with the pair of output shafts journaled for rotation adjacent each respective end by the two plates, and the drive shaft extending between the plates, and wherein each crank arm assembly is connected to each output shaft outside of the two plates.

* * * * *

UNITED STATES PATENT AND TRADEMARK OFFICE

CERTIFICATE OF CORRECTION

PATENT NO. : 6,067,886
DATED : May 30, 2000
INVENTOR(S) : Jere F. Irwin

It is certified that error appears in the above-identified patent and that said Letters Patent is hereby corrected as shown below:

Abstract:
Line 16, delete "arrange such", and insert -- arranged such --.
Line 19, delete "the associate weight", and insert -- the associated weight --.

Specification:
Column 1,
Line 40, delete "locations that severe", and insert -- locations that sever --.
Line 60, delete "suitable to severe", and insert -- suitable to sever --.

Column 3,
Line 54, delete "arrange such", and insert -- arranged such --.
Line 57, delete "the associate weight", and insert -- the associated weight --.

Column 4,
Line 53, delete "Four, vertical", and insert -- Four vertical --.

Column 6,
Line 33-34, delete "The inputs shafts 36", and insert -- The input shafts 36 --.
Line 52, delete "above plate 12", and insert -- above platen 12 --.

Column 9,
Line 8, delete "servo mechanism are", and insert -- servo mechanism is --.

Claims:
Column 13,
Lines 21-22, claim 7, delete "pair of drive shafts, transfer cases, and output shaft by the frame", and insert -- drive shaft and the transfer cases by the frame --.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*